US009868070B2

(12) United States Patent
Bentsen

(10) Patent No.: US 9,868,070 B2
(45) Date of Patent: Jan. 16, 2018

(54) PLAYGROUND EQUIPMENT

(71) Applicant: Kompan A/S, Odense SØ (DK)

(72) Inventor: Nikolaj Maj Bentsen, Vejle Ø (DK)

(73) Assignee: Kompan A/S, Odense SØ (DK)

( * ) Notice: Subject to any disclaimer, the term of this patent is extended or adjusted under 35 U.S.C. 154(b) by 0 days.

(21) Appl. No.: 15/309,110

(22) PCT Filed: May 4, 2015

(86) PCT No.: PCT/EP2015/059705
§ 371 (c)(1),
(2) Date: Nov. 4, 2016

(87) PCT Pub. No.: WO2015/169739
PCT Pub. Date: Nov. 12, 2015

(65) Prior Publication Data

US 2017/0106294 A1 Apr. 20, 2017

(30) Foreign Application Priority Data

May 6, 2014 (EP) ..... 14167118

(51) Int. Cl.

| | |
|---|---|
| ***A63G 1/40*** | (2006.01) |
| ***A63B 22/18*** | (2006.01) |
| ***A63B 23/02*** | (2006.01) |
| ***A63B 26/00*** | (2006.01) |
| ***A63G 1/12*** | (2006.01) |

(52) U.S. Cl.
CPC ..... *A63G 1/40* (2013.01); *A63B 22/18* (2013.01); *A63B 23/0205* (2013.01); *A63B 26/003* (2013.01); *A63G 1/12* (2013.01); *A63B 2208/12* (2013.01)

(58) Field of Classification Search
CPC ..... A63B 22/00; A63B 22/14; A63B 21/0058; A63G 13/00; A63G 13/08; A63G 23/00
USPC ..... 472/135, 14, 18, 19, 24
See application file for complete search history.

(56) References Cited

U.S. PATENT DOCUMENTS

| | | | | |
|---|---|---|---|---|
| 2,111,848 A | | 3/1938 | Erhardt et al. | |
| 2,467,338 A | * | 4/1949 | Sellards | A63B 22/14 472/18 |
| 2,862,710 A | * | 12/1958 | Lewis | A63G 13/08 248/160 |
| 3,073,595 A | | 1/1963 | Jones | |
| 3,649,007 A | * | 3/1972 | Thomas | A63G 23/00 472/135 |

(Continued)

FOREIGN PATENT DOCUMENTS

EP 1747803 A1 1/2007

*Primary Examiner* — Kien Nguyen
(74) *Attorney, Agent, or Firm* — Knobbe, Martens, Olson & Bear, LLP

(57) ABSTRACT

The invention relates to a playground equipment comprising a platform for a user to sit or stand on and mounted to the ground via a first shaft and a second shaft. The shafts are connected to each other at an angle and coupled in a gear transmission system. Because of the gearing between the shafts a first rotational speed of the first shaft yields a second rotational speed of the second shaft different from the first rotational speed. The gear transmission system may comprise an epicyclic gear train such as a planetary gear system. The gear transmission system may yield a gear ratio in the range of 1.5-10 such as in the range of 3-7.

15 Claims, 2 Drawing Sheets

(56) References Cited

U.S. PATENT DOCUMENTS

| | | | | | |
|---|---|---|---|---|---|
| 4,290,601 | A | | 9/1981 | Mittelstadt | |
| 4,620,700 | A | | 11/1986 | Snarr | |
| 4,671,506 | A | * | 6/1987 | Sutherland | A63G 1/12 472/18 |
| 4,905,996 | A | * | 3/1990 | Tallent | A63B 63/00 273/401 |
| 7,465,262 | B2 | * | 12/2008 | Ho | A63B 21/0058 482/146 |

* cited by examiner

PLAYGROUND EQUIPMENT

CROSS REFERENCE TO RELATED APPLICATIONS

This application is a U.S. National Phase Application of PCT International Application Number PCT/EP2015/059705, filed on May 4, 2015, designating the United States of America and published in the English language, which is an International Application of and claims the benefit of priority to European Patent Application No. 14167118.0, filed on May 6, 2014. The disclosures of the above-referenced applications are hereby expressly incorporated by reference in their entireties.

FIELD OF THE INVENTION

The present invention relates to a playground equipment comprising a platform for a user to sit or stand on and mounted to the ground via a shaft.

BACKGROUND

Carousels, merry-go-rounds, playground rides, or playground roundabouts have long been a popular equipment on playgrounds for children of all ages, and can be found in numerous different configurations, sizes, functionality, and designs.

Typically such playground roundabouts comprise some sort of platform or seats to accommodate the one or more users and which then is turned either mechanically, by others or by the persons on the roundabout themselves.

Different types of roundabouts exist yielding different types of movement of the user not only making the user circle in a horizontal plane but also move up and down, or spin around his own axis etc.

U.S. Pat. No. 3,073,595 describes a playground ride where the seating platform is arranged on two freely rotating and separated hubs whose axis of ration are angularly offset resulting in a special combination of circular motion and vertical motion. As the seating platform can be rotated fast or slowly and in changing direction relative to the rotation of the base column is obtained a more exhilarated ride where the resulting movement is perceived as unpredictable by the user.

Another type of exercising device is described in U.S. Pat. No. 4,290,601 comprising a wobble plate mounted on a single shaft to a base and placed on one side on top of a roller assembly thereby creating a raised position of one portion of the wobble plate. The roller assembly is in one embodiment made from pair of hemispherical balls and held in its radial position by a radial arm connected to the shaft. A person standing on the wobble plate can then set the board in motion. The design with the roller assembly moving between the base and the underside of the wobble board however yields a construction with a relatively high number of movable parts and with a number of places where objects such as clothes, fingers etc. can get caught or entangled. The latter especially makes the exercise device unsuitable as a playground equipment.

EP 1747803 discloses an exercising apparatus of an oscillating platform placed at an angle relative to a support platform and free to rotate around two non-parallel axes. Different configurations of the plate and the axes relative to each other yield different types of motion of the user. Also, the platform rotating assembly may be driven by a gear assembly configured to rotate the platform at a predetermined rate such that the platform rotates relative to the platform by a predetermined amount during use. Thereby the amount of oscillating can be controlled however without influencing the type of motion of the user.

DESCRIPTION OF THE INVENTION

It is an object of embodiments of the invention to provide a playground equipment which can be used by one or more players to create a fun and different type of motion.

It is a further object of embodiments of the invention to provide a playground equipment which is both fun and challenging for the user to play on and which both challenges and develops the user's balance, responsiveness and motor skills.

In accordance with the invention this is obtained by a playground equipment comprising a platform for a user to sit or stand on, wherein the platform is mounted to the ground via a first shaft and a second shaft which shafts are connected to each other at an angle, and wherein the shafts are coupled in a gear transmission system with a gear ratio different from one such that a first rotational speed of the first shaft yields a second rotational speed of the second shaft different from the first rotational speed.

The connected first and second shafts extend between the ground and the platform.

Hereby is obtained a playground equipment which in some aspects resembles a traditional playground roundabout, however yielding a more advanced movement of the user which is both more advanced and intriguing than for example a simple rotation yet still fully controllable by the user throughout a playing sequence. By the playground equipment according to the invention is obtained a new kind of play which by some has been described as in some ways comparable to board surfing. Playing on the playground equipment challenges and develops the players physics, responsiveness, body control and sense of balance in that every movement of the user affects the movement of the platform. By the claimed coupling between the shafts in a gear transmission system is obtained that the platform of the playground equipment can be set in motion, and its movement can be both changed in a controlled manner, and continuously controlled by the user by using the body weight and body movement. This is in contrast to some of the known playground rides, where the object is more to obtain as crazy and unpredictable movement of the user as possible.

Further is obtained a playground equipment which can be set in motion and operated both by the player himself or be activated by co-players and bystanders which are not on the playground equipment.

The playground equipment may be mounted to the ground for example by means of a foundation or a support base. One of the shafts may be directly or indirectly connected to the ground preferably in a connection allowing both the shaft to rotate and the loads from the playground equipment and the user(s) to be transferred to the ground. The connection may preferably comprise a rotational bearing holding the shaft.

The platform may be firmly attached directly or indirectly to one of the two shafts for example by welding or by means of bolts or the like. Alternatively the platform may be connected to one of the two shafts in a joint allowing for a certain relative movement between the platform and the shaft, such as for example to allow for the platform to rotate and/or tilt and/or slide relative to the shaft.

The first shaft and the second shaft are connected to each other and coupled in a gear transmission system which may include a number of gears and bearings. The gear transmission system may be placed in a gear house in the playground equipment or otherwise shielded off. The gear ratio or speed ratio is here and in the following used to express the ratio of the angular velocity of the input gear to the angular velocity of the output gear, or in other words to express the ratio between the rotational speed of the first and the rotational speed of the second shaft. By a gear ratio different from one is simply obtained that a certain rotational speed of the first shaft yields a certain different rotational speed of the second shaft.

By the first and the second shaft being connected to each other in an angle is obtained that the rotational axes of the two shafts are inclined or angled. In this way is obtained a combination of rotations in two different planes inclined relative to each other. The user is thus both moved around in circles and up and down.

The playground equipment may comprise a housing in which the first and second shafts are placed completely or partly. The housing may be cylindrical and may comprise a bend or a kink corresponding to the angle between the two shafts. The housing may be attached to one of the shafts and mounted to rotate with the shaft, while the other shaft is free to rotate relative to the housing. The housing may be arranged to rotate on a foundation or a base for example by means of a set of wheels.

The platform may conveniently be of a size suitable to accommodate a person in different positions such as sitting, kneeling, standing, or lying down. The platform may be manufactured in different sizes and materials adapted to children of different ages, weight, and sizes.

The platform may in one embodiment be circular or of another round shape whereby corners are avoided and the risk of a bystander being bruised or injured by the rotating platform is minimized.

In one embodiment the shafts are coupled either such as to rotate in opposite directions or to rotate in the same direction. By coupling the first and second shafts in the gear transmission system such that they rotate the same way is obtained a system where the user when making the platform rotate in one direction will experience a general resulting movement relative to the surroundings in the same direction but at a different speed as determined by the gear ratio. Similarly, when the first and second shafts in the gear transmission system are coupled such as to rotate in opposite directions is obtained a system where the user when making the platform rotate in one direction will experience a general resulting movement relative to the surroundings at a different speed as determined by the gear ratio. Experiments have shown that the playground equipment hereby functions advantageously in that the claimed gearing provides a user a special and intriguing kind of motion which can be to a certain degree controlled and steered by the movements of the user. The embodiments of the shafts rotating in opposite or in the same direction yield two different kinds of motion of the platform and each embodiment result in a playground equipment which during play gives a different and intriguing playing experience compared to conventional roundabouts.

In an embodiment of the invention the first and second shafts are connected at an angle in the range of 5-50 degrees, such as in the range of 10-30 degrees. Hereby is obtained a certain advantageous amount of up-and down motion of the user on the platform relative to the rotation. The up-and down motion (and thereby the angle between the shafts) is advantageously so large as to make the resulting overall motion of the user fun and exciting, and not so large that the user falls off too easily or has severe difficulties in staying on the platform during the rotation of playground equipment. Preferably the angle is around 15 degrees.

According to an embodiment of the invention, the platform forms an angle to horizontal in the range of 5-50 degrees such as in the range of 10-30 degrees. Hereby is obtained a certain advantageous amount of up-and down motion of the user on the platform relative to the rotation. The tilting of the platform is advantageously so large as to make the resulting overall motion of the user fun and exciting, and not so large that the user falls off too easily or has severe difficulties in staying on the platform during the rotation of playground equipment.

In an embodiment of the invention, the gear transmission system comprises an epicyclic gear train or planetary gearing, such as a planetary gear system. Hereby may be obtained the desired gearing between the first and second shaft. A planetary gear train may advantageously provide high power density in comparison to standard parallel axis gear trains. The epicyclic gear train may further be arranged at a relatively low volume yet arranged to yield a high efficiency ensuring a reduced waste on mechanical losses inside the gearbox. As the loads in an epicyclic gear train are shared among multiple planets, torque capability may be greatly increased along with the load ability.

In an embodiment, the gear transmission system yields a gear ratio in the range of 1.5-10 such as in the range of 3-7. Hereby is obtained an advantageous fun and exciting motion for the user on the platform, where both a too low or high a gearing would yield either too low or too high a coupling effect between the rotations of the first and the second shaft. Preferably the gear ratio is around 5.

According to an embodiment the platform is attached to the first shaft and the gear transmission system is arranged such that a first rotation of the platform and of the first shaft yields a second rotational speed of the second shaft which is lower than the first rotational speed. Experiments have shown that hereby is obtained a disable resulting motion and a playground equipment which can be moved, played with and operated by a user in a fun and challenging yet controllable manner. As given by the gear ratio, the platform attached to the first shaft may be arranged to rotate 1.5-10 times faster than the second shaft, such as 3-7 times faster. Preferably the rotational speed of the platform is around 5 times higher than the rotational speed of the second shaft corresponding to a gear ratio of around 5.

In an embodiment, the platform is attached approximately perpendicularly to the first shaft. Alternatively, the platform may be attached to the first shaft at an angle different from 90 degrees.

In a further embodiment, the second shaft is mounted approximately vertically or approximately perpendicularly to the ground. Hereby the loads from the playground equipment may be better transferred to the ground.

According to a further embodiment of the invention the platform comprises an upper surface for the user to sit or stand on, wherein the surface is made of a rubber material and/or is textured. Hereby the platform is easier for the user to move on and to move and set in motion with minimal risk of slipping and falling.

The platform may in one embodiment comprise one or more grips and/or one or more protrusions and/or indentations. The platform may in this way be provided with means for aiding the user to move about the platform, for holding a certain position on the platform while rotating and for setting the platform into motion and controlling its rotation. The indentations or protrusions may be formed or shaped such as not to be obstacles and such that the user cannot fall over or get caught by when moving about the platform.

In a further embodiment of the invention the equipment further comprises a third shaft connected to the second shaft at an angle. The third shaft may further be connected to the second shaft in a further gear transmission system. Hereby is obtained a playground equipment yielding even further complex and intriguing types of motion for a user on the platform.

BRIEF DESCRIPTION OF THE DRAWINGS

In the following different embodiments of the invention will be described with reference to the drawings, wherein.

DETAILED DESCRIPTION OF THE DRAWINGS

Figure 1:
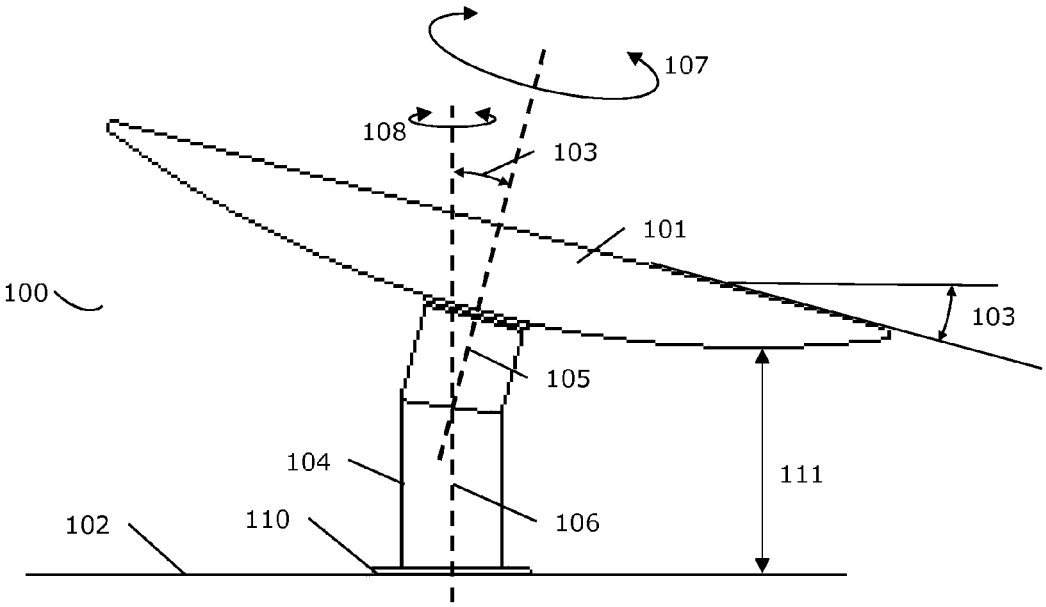
FIG. 1 shows an embodiment of the playground equipment according to the invention as seen in a side view.

FIG. 1 shows an embodiment of the playground equipment 100 according to the invention as seen in a side view. The playground equipment 100 comprises a platform 101 for a user to sit or stand on, which is mounted to the ground 102 via a first shaft and a second shaft which shafts are connected to each other at an angle 103, and are coupled in a gear transmission system (not shown). The first and second shafts are placed within the housing 104. The rotational axes 105,106 of the two shafts are indicated by the dashed lines. The gear ratio of the gear transmission system is different from one such that a first rotational speed of the first shaft as indicated by the arrow 107 yields a second rotational speed of the second shaft as indicated by the arrow 108 different from the first rotational speed.

During play, a user on the platform can by use of his or hers body weight set the platform into motion wherein the platform rotates 107 with the first shaft around the first rotational axis 105, while the entire equipment then rotates 108 around the second rotational axis 106 but at a rotational different speed. The user on the platform is then both moved up and down due to the angle between the shafts, and around in circles. The gearing between the two shafts creates a very special kind of motion.

In a preferred embodiment the gear ratio is around 5 and such that the platform 101 rotates 5 times faster than the second shaft of the rotational axis 109, i.e. 5 times faster than the entire playground equipment 100 relative to the ground. In a preferred embodiment as illustrated in FIG. 1, the two shafts are angled 103 approximately 5 degrees and the platform is angled 103 equivalent to horizontal.

The platform may be circular or of an oval shape and of a size such as to conveniently accommodate one teenager or 1-2 smaller children. The diameter of the platform may for example be in the range of 1.5-2.5 meters. The platform 101 may be arranged in a distance 111 above the ground, which is large enough to avoid any bystanders being somehow squeezed by the rotating platform yet small enough to prevent any severe accidents if a user falls off the platform when playing. The distance may for example be in the range of 0.20-1.0 meter or for example around 0.4 meters.

The equipment may be bolted or otherwise firmly attached to the ground for example by bolts attached to the disk 110.

Figure 2A:
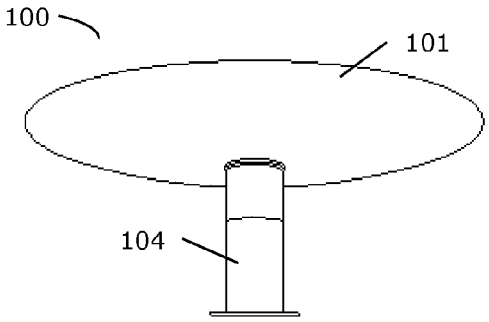
FIG. 2A-B show the playground equipment in two different perspective views.
Figure 2B:
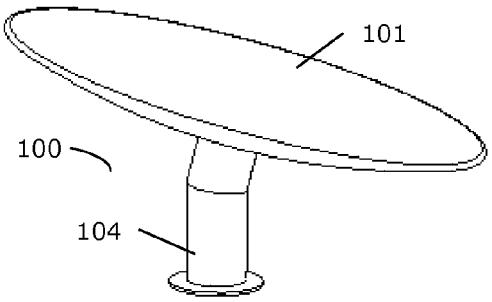

FIGS. 2A and 2B show the playground equipment 100 of FIG. 1 in two different perspective views. In FIG. 2A the playground equipment is seen in a view and at a time where the platform 101 is tilted away from the viewer. In FIG. 2B the playground equipment is seen in a perspective view a little from the above. From the figures can be seen that the platform 101 at all times is in a tilted position, but tilted in different directions as the playground equipment rotates. The housing 104 is arranged such as to completely shield off all moving parts so that there is no risk of a finger, a shoelace or the like getting caught during the rotational movement of the playground device.

Figure 3:
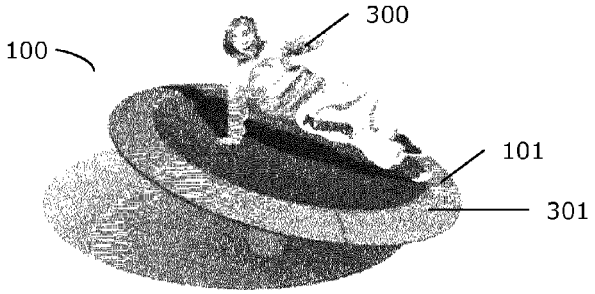
FIG. 3 illustrates the playground equipment in use by a child.

The same playground equipment 100 is sketched in FIG. 3 as in use with a child 300 playing on it. Here, the platform 101 comprises an outer rim 301 which aids in defining and marking the play area, thereby helping the user to not unintentionally fall off the platform during play.

Figure 4:
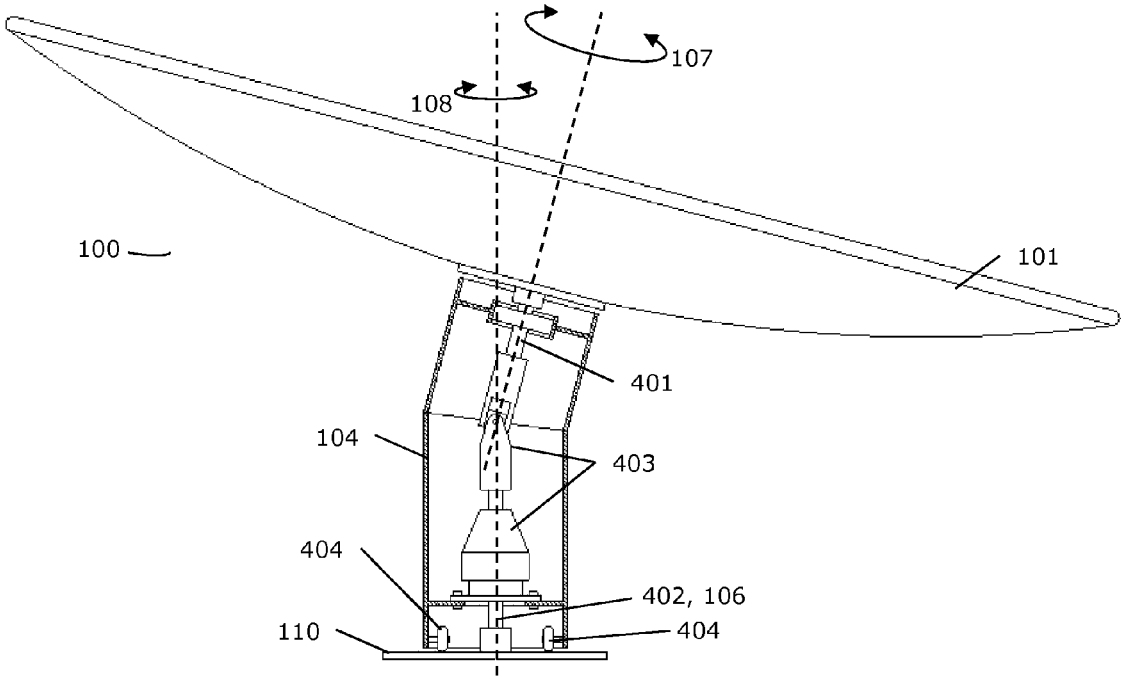
FIG. 4 shows an embodiment of a playground equipment in a cross sectional view where the shafts and gearing are outlined.

FIG. 4 shows an embodiment of the playground equipment 100 in a partly cross sectional view. The playground equipment comprises a housing 104 consisting of two cylinders welded together at an angle. The first shaft 401 is connected to the platform 101 at its one end and coupled to the second shaft 402 at its other end in the gear transmission system 403 comprising a planetary gear. As the platform is set in motion and rotates with the first shaft 401 around the first rotation axis 105, this causes the second shaft 402 and the housing along with it to be rotated about the second rotational axis 106. As illustrated in FIG. 4, the housing is mounted on the disk via a number of rollers or wheels 404.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A playground equipment comprising a platform for a user to sit or stand on, wherein the platform is mounted to the ground via a first shaft and a second shaft, which are connected to each other at an angle, wherein the platform is configured to rotate with the first shaft around a first rotational axis aligned with the rotational axis of the first shaft, wherein the playground equipment is configured to rotate around a second rotational axis aligned with the rotational axis of the second shaft, and wherein the first and second shafts are coupled in a gear transmission system with a gear ratio that is different from one another such that a first rotational speed of the first shaft yields a second rotational speed of the second shaft, which is different from the first rotational speed of the first shaft such that the platform is configured to rotate with the first shaft around the first rotational axis at the first rotational speed while the playground equipment rotates around the second rotational axis at the second rational speed.

2. The playground equipment according to claim 1, wherein the shafts are coupled and rotate in opposite directions.

3. The playground equipment according to claim 1, wherein the shafts are coupled and rotate in the same direction.

4. The playground equipment according to claim 1, wherein the first and second shafts are connected at an angle in the range of 5-50 degrees or in the range of 10-30 degrees.

5. The playground equipment according to claim 1, wherein the platform forms an angle to the horizontal plane that is in the range of 5-50 degrees or 10-30 degrees.

6. The playground equipment according to claim 1, wherein the gear transmission system comprises an epicyclic gear train or a planetary gear system.

7. The playground equipment according to claim 1, wherein the gear transmission system yields a gear ratio in the range of 1.5-10 or in the range of 3-7.

8. The playground equipment according to claim 1, wherein the platform is attached to the first shaft and, wherein the gear transmission system is configured such that the second rotational speed of the second shaft is lower than the first rotational speed of the first shaft.

9. The playground equipment according to claim 1, wherein the platform is attached approximately perpendicularly to the first shaft.

10. The playground equipment according to claim 1, wherein the second shaft is mounted approximately vertically.

11. The playground equipment according to claim 1, wherein the platform comprises an upper surface for the user to sit or stand on, wherein the surface is made of a rubber material.

12. The playground equipment according to claim 1, wherein the platform comprises an upper surface for the user to sit or stand on, wherein the surface is textured.

13. The playground equipment according to claim 1, wherein the platform comprises one or more grips.

14. The playground equipment according to claim 1, wherein the platform comprises one or more protrusions and/or indentations.

15. The playground equipment according to claim 1, wherein the equipment further comprises a third shaft connected to the second shaft at an angle.

* * * * *